US008176697B1

(12) United States Patent
Bolander, II

(10) Patent No.: US 8,176,697 B1
(45) Date of Patent: May 15, 2012

(54) BUILDING BLOCK

(76) Inventor: Larry J. Bolander, II, Oregon, OH (US)

( * ) Notice: Subject to any disclaimer, the term of this patent is extended or adjusted under 35 U.S.C. 154(b) by 0 days.

(21) Appl. No.: 12/870,104

(22) Filed: Aug. 27, 2010

Related U.S. Application Data

(60) Provisional application No. 61/238,875, filed on Sep. 1, 2009.

(51) Int. Cl.
*E04C 1/00* (2006.01)

(52) U.S. Cl. ..... 52/309.4; 52/309.12; 52/309.15; 52/309.17

(58) Field of Classification Search ..... 52/309.4, 52/309.12, 309.15, 309.17
See application file for complete search history.

(56) References Cited

U.S. PATENT DOCUMENTS

| | | | | |
|---|---|---|---|---|
| 1,704,255 | A | | 3/1929 | Lewis |
| 3,102,367 | A | | 9/1963 | Pedersen et al. |
| 3,417,533 | A | | 12/1968 | Sparling |
| 4,107,894 | A | * | 8/1978 | Mullins ..... 52/592.6 |
| 4,232,494 | A | * | 11/1980 | Bauch et al. ..... 174/504 |
| 4,274,824 | A | * | 6/1981 | Mullins ..... 425/253 |
| 4,965,979 | A | * | 10/1990 | Larrivee et al. ..... 52/592.6 |
| 5,181,362 | A | | 1/1993 | Benitez |
| 5,230,195 | A | * | 7/1993 | Sease ..... 52/592.6 |
| 5,549,418 | A | * | 8/1996 | Devine et al. ..... 405/258.1 |
| D377,397 | S | | 1/1997 | Craig |
| 5,647,185 | A | * | 7/1997 | Forlini ..... 52/604 |
| 5,791,827 | A | * | 8/1998 | Arvai et al. ..... 405/286 |
| 5,934,037 | A | * | 8/1999 | Bundra ..... 52/603 |
| 6,523,312 | B2 | | 2/2003 | Budge |
| 6,948,282 | B2 | | 9/2005 | Bott |
| 2007/0234665 | A1 | * | 10/2007 | Price ..... 52/311.1 |
| 2008/0060300 | A1 | * | 3/2008 | Westmoreland et al. .... 52/405.4 |
| 2009/0093560 | A1 | * | 4/2009 | Van Rheenen et al. ..... 521/134 |
| 2009/0193740 | A1 | * | 8/2009 | Bennett ..... 52/309.1 |

* cited by examiner

*Primary Examiner* — William Gilbert
*Assistant Examiner* — Mark Wendell
(74) *Attorney, Agent, or Firm* — MacMillan, Sobanski & Todd, LLC

(57) ABSTRACT

Plastic building blocks made from structural foam polymer such as polyethylene, polypropylene or acrylonitrile butadiene styrene are strong, lightweight and may be easily disassembled. The top surface of each block has frusto-conical posts which fit into corresponding bores in the bottom surface of adjacent blocks to provide interlocking capability.

19 Claims, 10 Drawing Sheets

BUILDING BLOCK

CROSS-REFERENCE TO RELATED APPLICATION

This application claims the benefit of U.S. Provisional Application No. 61/238,875 filed Sep. 1, 2009, the disclosure of which is incorporated herein by reference.

FIELD OF THE INVENTION

This invention relates to construction materials in general and more particularly to building blocks.

BACKGROUND OF THE INVENTION

Cinder blocks are commonly used to construct walls and similar structures. Cinder blocks are adequate for a variety of uses, particularly for permanent structures such as buildings. Cinder blocks typically are joined together with mortar to form permanent structures. However, occasionally there is a need to construct a wall or similar structure which is not intended or desired to be permanent.

In addition, typical cinder blocks weigh approximately 38 pounds. Weight is a significant factor in transportation and construction costs. This has not been a major obstacle with permanent structures because the cost is incurred only once. However, on occasion there is a need for buildings or structures which may be disassembled and, in some instances reassembled or reconfigured, possibly in different locations. Excessive weight is not an advantage if building materials are intended for reuse, as the costs would multiply.

SUMMARY OF THE INVENTION

The present invention is a building block which may be assembled into a wall or similar structure and then disassembled. Preferably the building block is made of a light weight material such as a plastic and includes means for interlocking with adjacent blocks. Preferably a wall constructed of building blocks can be mechanically fastened together and easily disassembled. Various aspects of this invention will become apparent to those skilled in the art from the following detailed description of the preferred embodiment, when read in light of the accompanying drawings.

DETAILED DESCRIPTION OF A PREFERRED EMBODIMENT

Figure 1:
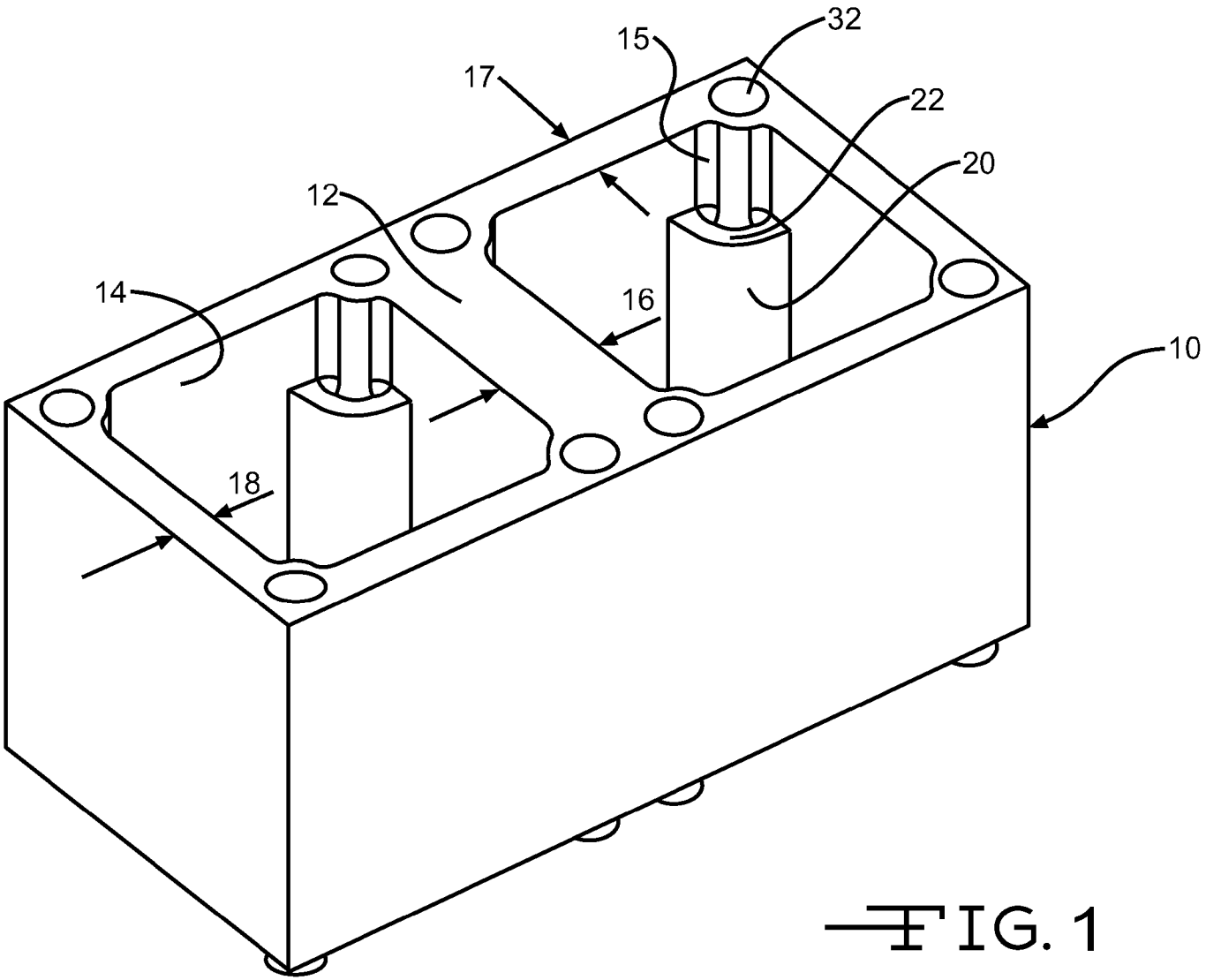
FIG. 1 is a perspective top view of a building block of the present invention.

Referring to FIG. 1, a generally rectangular building block 10 is sized generally as a standard cinder block. The exterior dimensions are approximately 16×8×8 inches, and more specifically 15.75 inches in length 7 by 7.75 inches in width 8 by 7.75 or 8.0 inches in height 9. The exterior wall thickness 17, 18 is approximately one inch. A center interior wall 12 has a thickness 16 of approximately 2.25 inches. The center interior wall 12 creates two approximately square openings 14 having a size of 5.75 inches by 5.75 inches. The corners of openings 14 are beveled. The top surface of block 10 has eight frusto-concial holes or bores 32, one adjacent each of the eight beveled corners 15.

Figure 2:
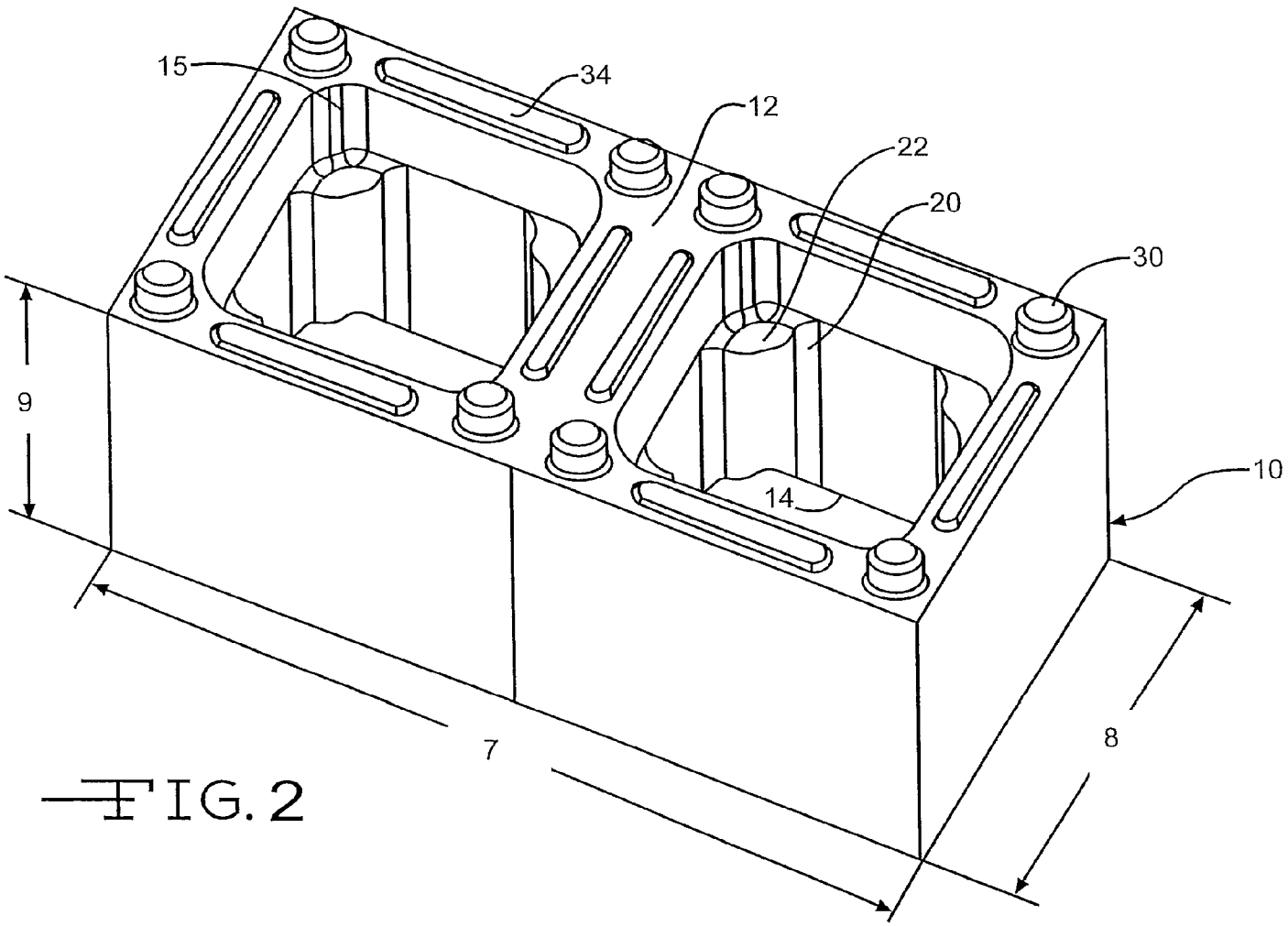
FIG. 2 is a perspective bottom view of a building block of the present invention.

Referring to FIG. 2, the bottom surface of block 10 includes 8 frusto-conical posts 30 corresponding in size and shape to the bores 32. The posts 30 are approximately 0.75 inches high and approximately one inch in diameter at the base.

The interior openings 14 include integral reinforcements 20 in each corner. Each reinforcement 20 extends into the interior of the block beyond the beveled corners 15. The reinforcements are centered relative to the height 9 of the block. The reinforcements are approximately 3.75 inches long. Each reinforcement 20 has a generally planar top and bottom surface 22 of about 0.43 square inches. The size of the reinforcements 22 may vary depending upon the intended use of the blocks and, of course, the size of the blocks.

Eight integral spacers 34 having a height of approximately one-quarter inch are positioned between the corners 15 of each opening 14. Each spacer 34 has a length of about 3.535 inches and width of about 0.322 inches. These sizes have been found to be optimal for a standard size block, but of course may vary depending on the intended use and whether different block sizes are used. It may be possible to change the block size and dimensions if all other dimensions are changed generally proportionally.

Assembly of a wall can be done easily and precisely by interlocking the blocks, with posts 30 fitting into bores 32. The spacers 34 will insure precise spacing of the block assembly. The posts and bores are dimensioned such that a slight interference fit is formed, but easy removal is possible. A staggered block pattern is preferred (see FIGS. 8 and 9), just as in typical walls formed with cinder block.

Figure 3:
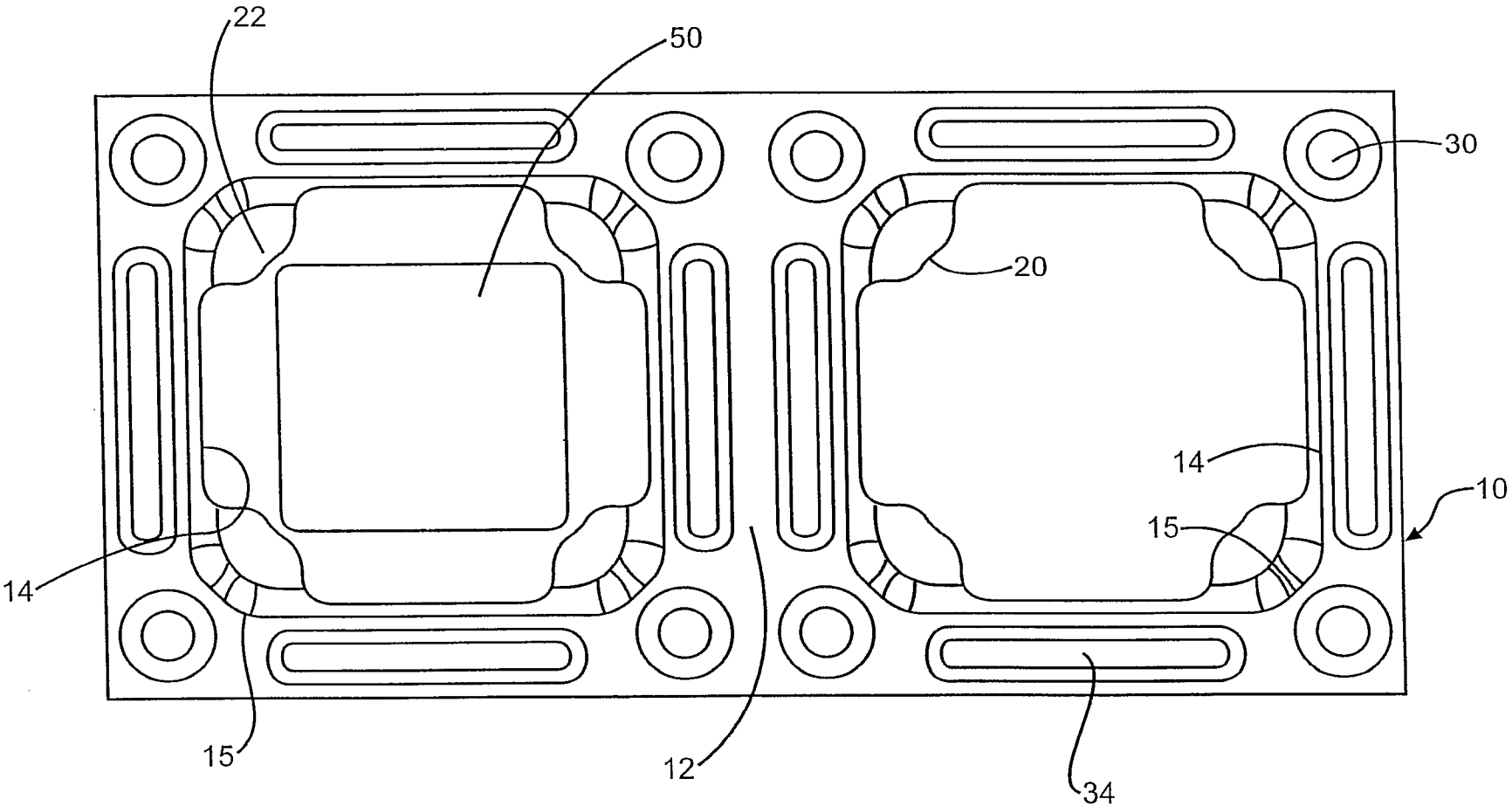
FIG. 3 is a bottom view of a building block of the present invention.

Referring to FIG. 3, a vertical wood post 50 may be inserted through several aligned block openings 14. Post 50 is a standard size (3.5 inches by 3.5 inches). The post can be anchored in or otherwise secured to the ground or other base to add stability to the wall. Several posts can be inserted at various places along the wall, such as the ends or corners.

Figure 3A:
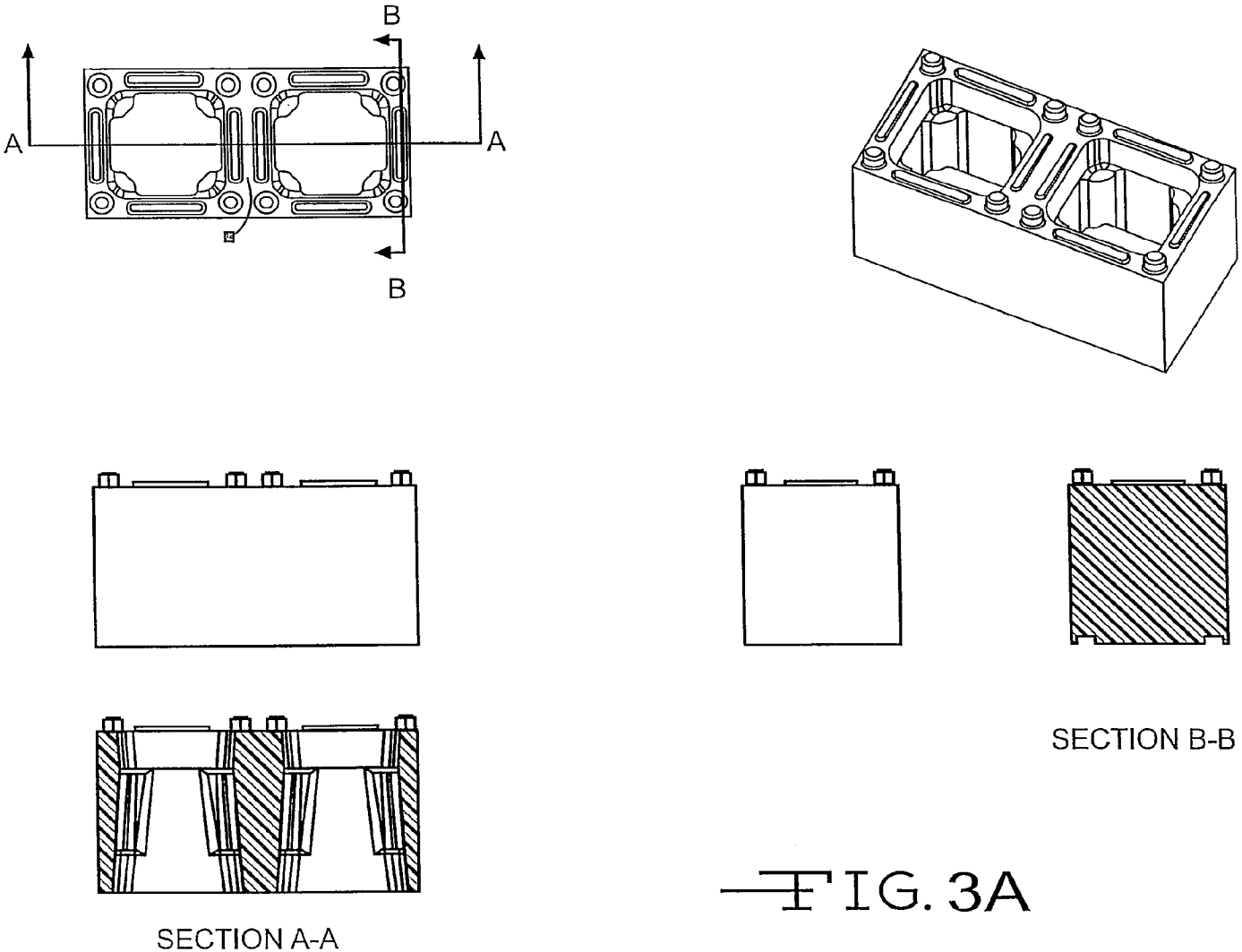
FIG. 3A includes additional views of the building block of FIG. 3.

FIG. 3A illustrates an alternative block design having tapered walls for added strength.

Figure 4:
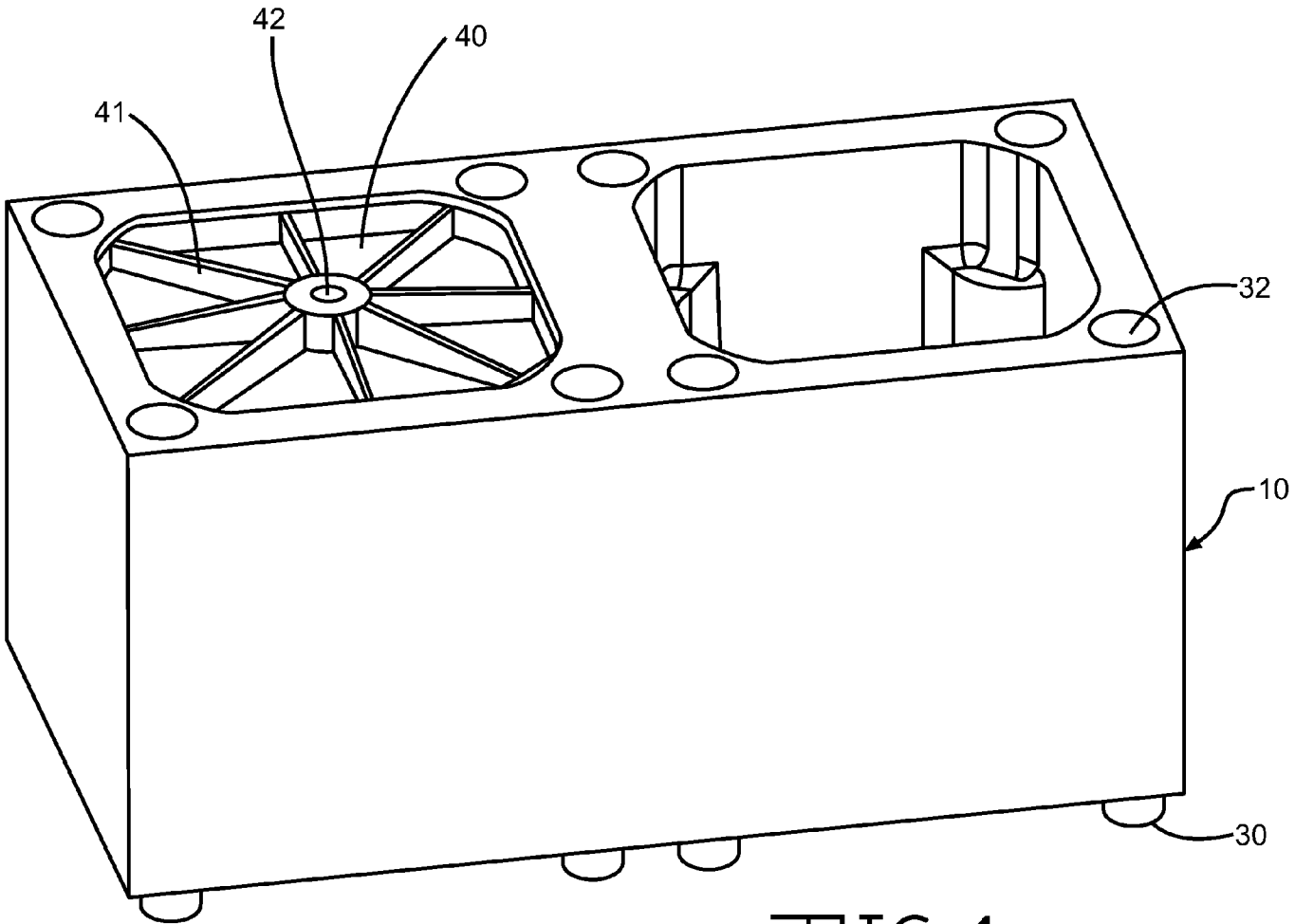
FIG. 4 is a perspective top view of a building block of the present invention.
Figure 5:
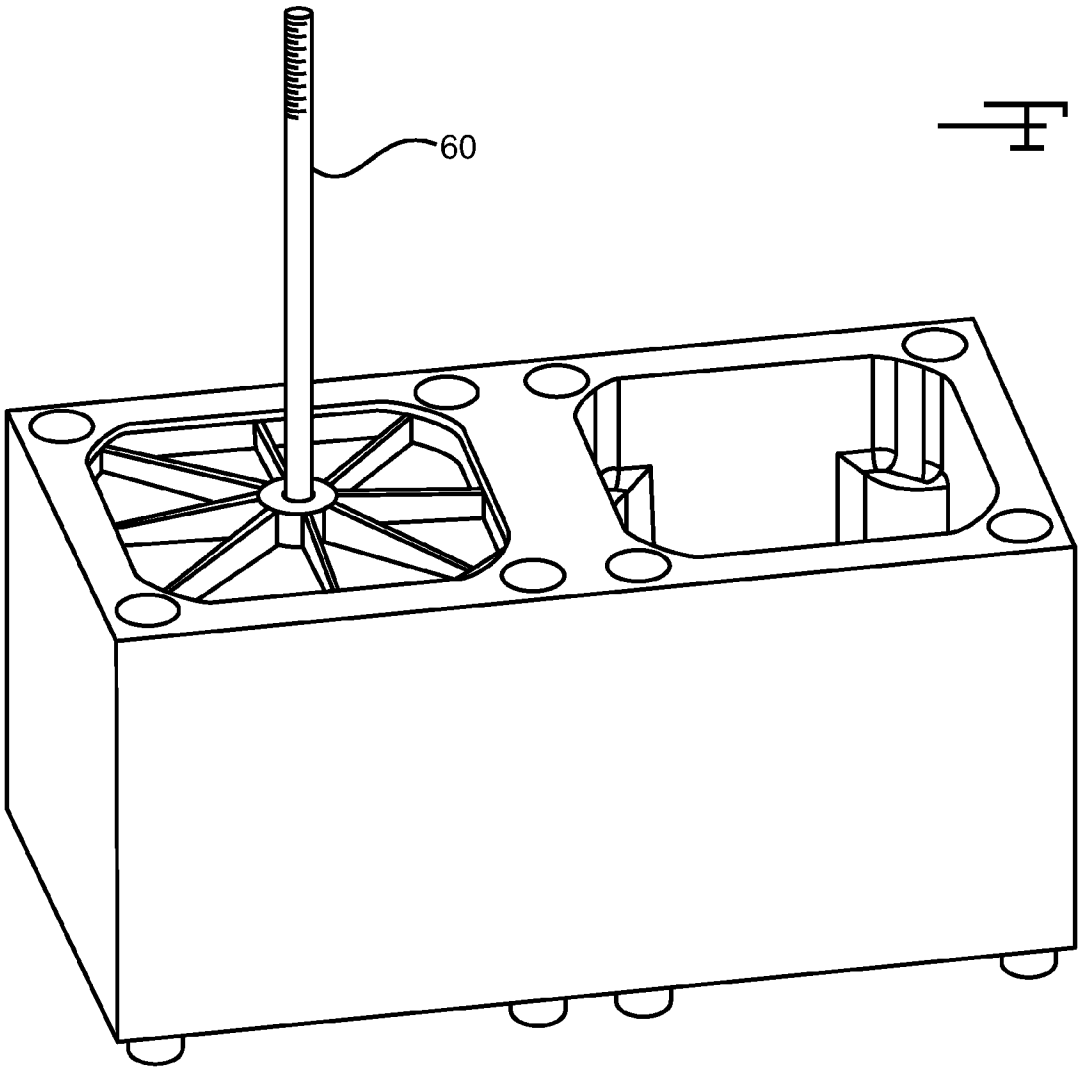
FIG. 5 is a perspective top view of a building block of the present invention.

Referring to FIG. 4, an end cap 40 may be interred into the opening 14 on a top layer or course block. The plate 40 is sized to fit within opening 14. The plate has reinforcing ribs 41 and a center opening 42. Referring to FIG. 5, the center opening 42 may be threaded to receive a threaded rod 60. Alternately, a rod 60 may be extended through opening 40 and a nut (not shown) or other securement means may be attached to apply pressure to the plate, and therefore to the block assembly, to secure the block assembly.

Figure 6:
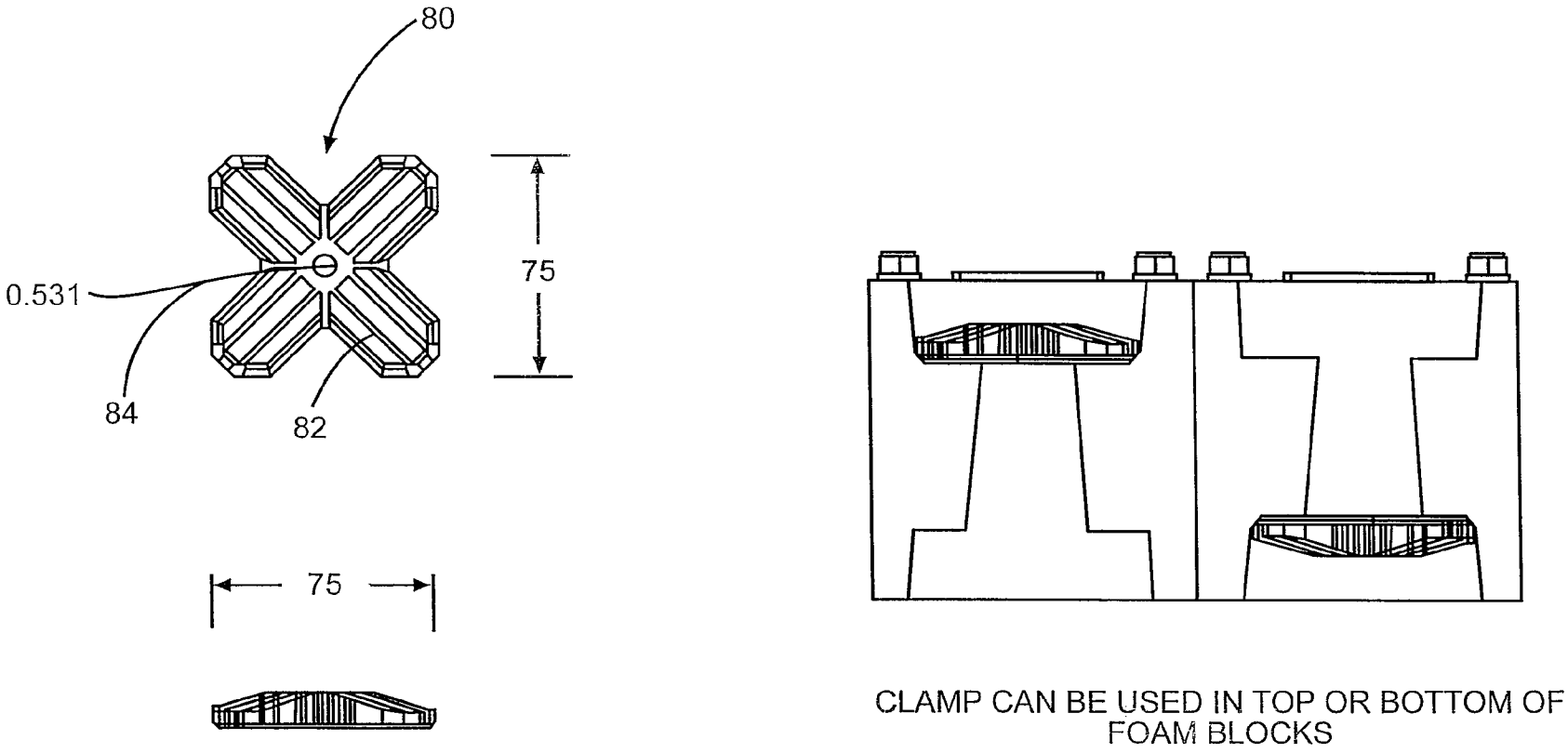
FIG. 6 is a sectional view of a building block of the present invention with an alternative end clamp.

FIG. 6 illustrates an alternative cap 80 in the form of a clamp for securing a block assembly. Clamp 80 has an "X" shape, with each leg adapted for engaging a corner reinforcement of an associated block, as shown. Clamp 80 is made of rigid plastic and has reinforcing ribs 82 to maintain strength without unnecessary weight. Clamp 80 has a center aperture 84 having a radius of about one-half inch which may or may not be threaded. Clamp 80 has a dimension 75 of about 5.375 inches. As shown in FIG. 6, clamp 80 can be used in either the top or bottom of a block of the present invention.

Figure 7:
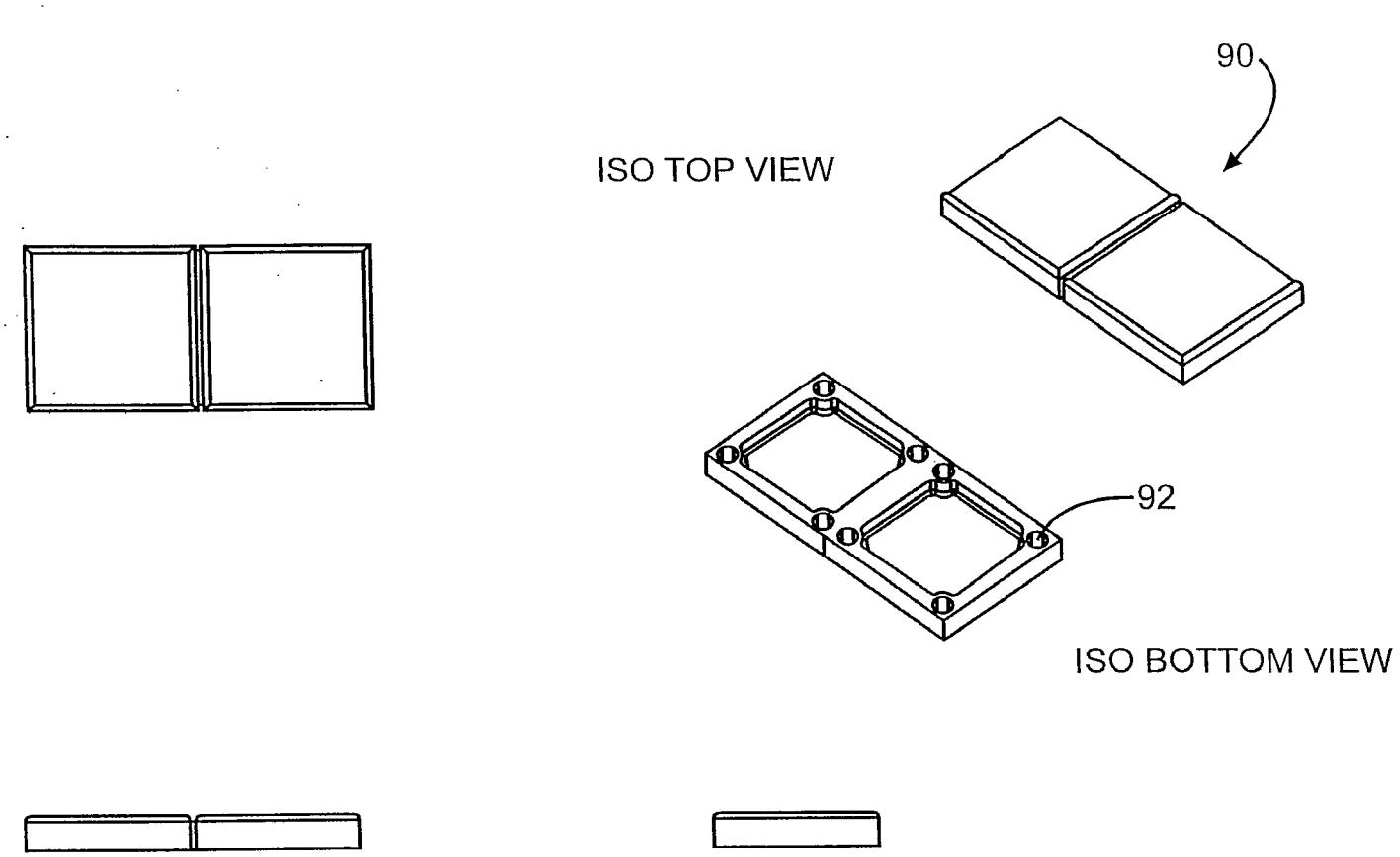
FIG. 7 includes views of caps used with building blocks.

FIG. 7 illustrates a plastic block end cap 90 having a thickness of about 1.5 inches. The end cap 90 includes eight bores 92 adapted to receive posts such as 30 in an associated block.

Figure 8:
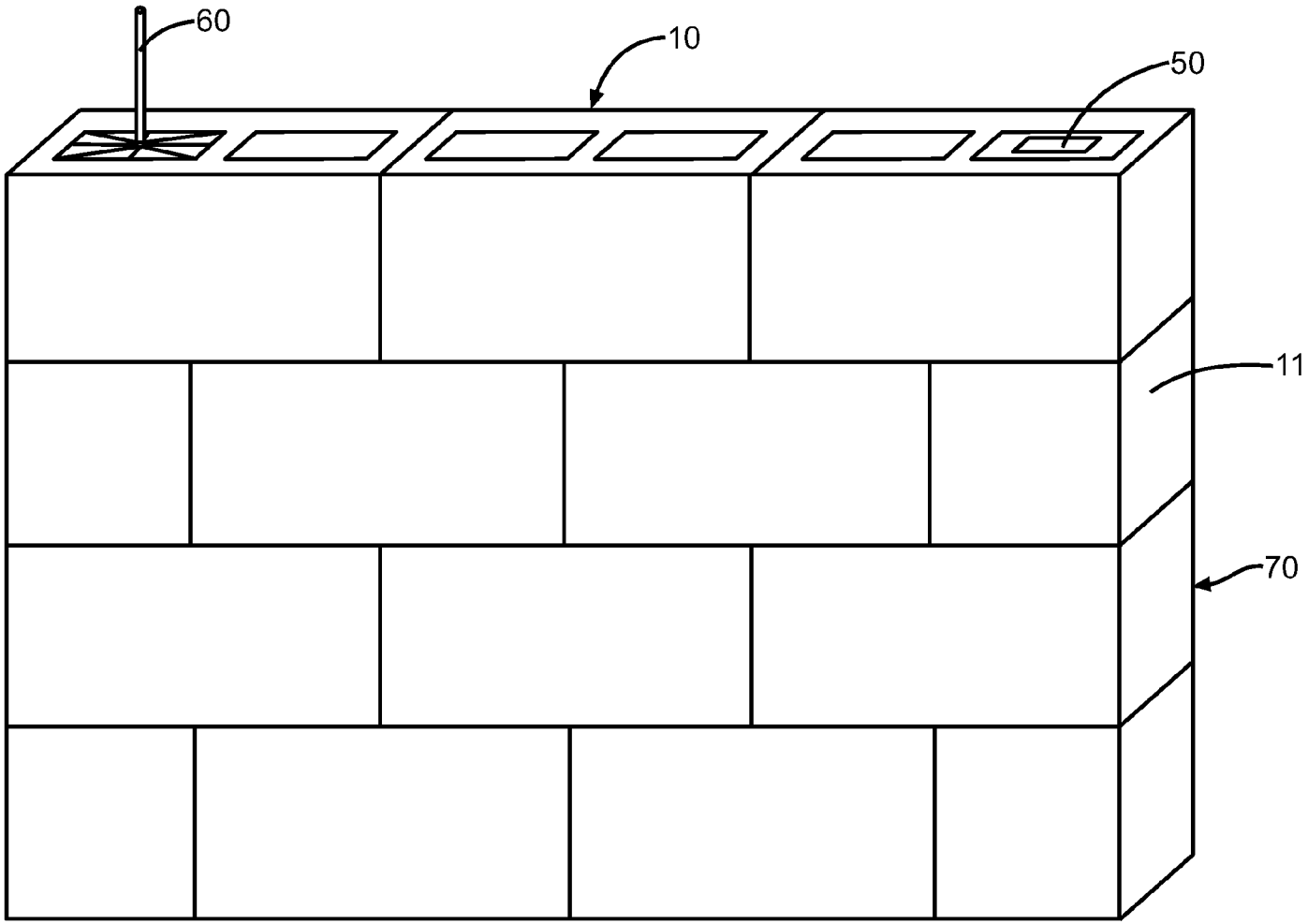
FIGS. 8 and 9 are assemblies of blocks of the present invention.

A wall or other structure formed by the blocks can easily be disassembled. Referring to FIG. 8, half size blocks 11 are contemplated so that a uniform end wall 70 may be created. For a more permanent structure, mortar of other adhesive may be added to the joints or spaces between blocks either for permanency or for appearance purposes.

Figure 9:
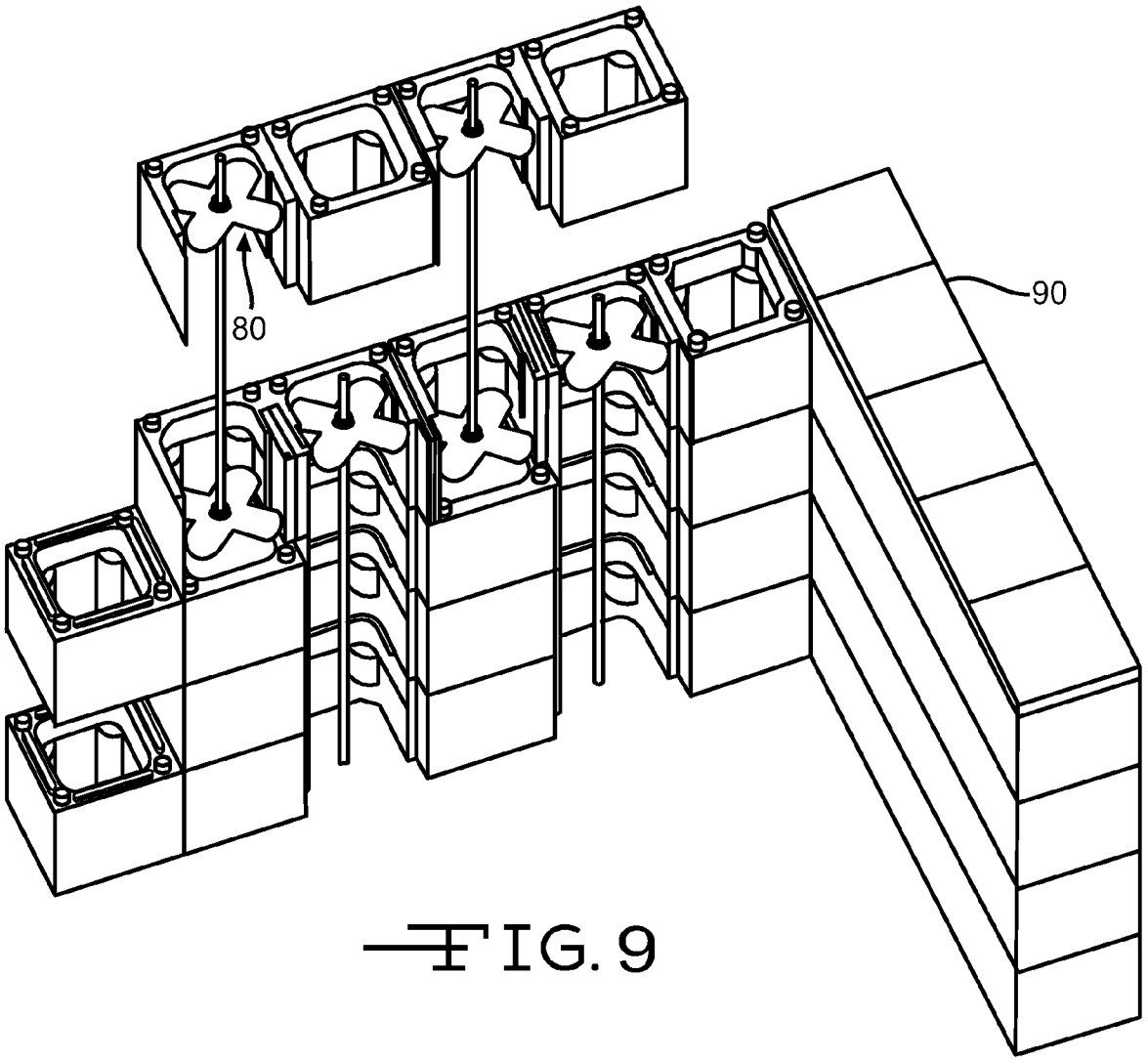

As shown in FIG. 9, a wall may be easily constructed and secured using a one-half inch threaded (preferably 13 threads per inch) rod optionally secured to a base (not shown) or the ground with a concrete anchor. The upper end of the rod engages a clamp with a nut tightening against the clamp to removably secure the block assembly. Caps 90 may be added to the top layer of blocks to seal the inside of the blocks from contaminants and debris.

The blocks 10 are constructed of structural foam, which is lightweight but strong and durable. Structural foam is commonly molded in a low-pressure injection molding process capable of producing large structural parts. In this common process, molten plastic material is injected into a mold after being mixed with a blowing agent or high-pressure gas. This produces bubbles in the plastic causing it to foam. The foam retains the properties of the plastic but weighs less because of reduced density.

Preferably, the resin used for the structural foam is high density polyethylene. Alternatively, other polymers may be used, such as acrylonitrile_butadiene styrene, and polypropylene. The end product is typically a rigid part with a relatively hard surface.

The weight of a block corresponding to a standard cinder block sized approximately 4 pounds.

The principle and mode of operation of this invention have been explained and illustrated in its preferred embodiment. However, it must be understood that this invention may be practiced otherwise than as specifically explained and illustrated without departing from its spirit or scope.

What is claimed is:

1. A structural foam polymer building block having a top surface and a bottom surface, wherein one of the top and bottom surfaces defines a plurality of bores, wherein the other of the top and bottom surfaces includes a plurality of posts extending from the other surface, and wherein one of the top and bottom surfaces includes a plurality of homogeneous spacers extending beyond the top or bottom surface, the spacers configured to engage a top or bottom surface of an adjacent block to prevent the top and bottom surfaces of adjacent blocks from touching.

2. A structural foam polymer building block as defined in claim 1 comprising molded polyethylene.

3. A structural foam polymer building block as defined in claim 1 comprising acrylonitrile butadiene styrene.

4. A structural foam polymer building block as defined in claim 1 comprising polypropylene.

5. A structural foam polymer building block as defined in claim 1 having a hollow core defining exterior walls and a central interior wall defining two chambers.

6. A structural foam polymer building block as defined in claim 5 wherein the chambers are generally square in cross-section and have beveled corners.

7. A structural foam polymer building block as defined in claim 5 wherein the chambers define integral reinforcements in each corner.

8. A structural foam polymer building block as defined in claim 7 wherein each reinforcement extends radially inwardly from the corners.

9. A structural foam polymer building block as defined in claim 8 wherein the reinforcements extend a vertical height less than the height of the block and are centered relative to the height of the block.

10. A structural foam polymer building block as defined in claim 5 wherein at least one wall is tapered.

11. A structural foam polymer building block as defined in claim 1 wherein the block has a length of approximately 16 inches, a height of approximately 8 inches and a depth of approximately 8 inches, and wherein the spacers are approximately 0.25 inches high, approximately 0.3 inches wide, and approximately 3.5 inches long.

12. A structural foam polymer building block as defined in claim 1 wherein the plurality of posts have a frusto-conical shape and extend generally perpendicularly to the other surface.

13. A structural foam polymer building block as defined in claim 1 further comprising a four-sided hollow core having four corners, an integral reinforcement in each corner, and a cap engaging the integral reinforcements.

14. An assembly of vertically arranged interlocked structural foam polymer building blocks, each block having a top surface and a bottom surface, wherein one of the top and bottom surfaces of each block defines a plurality of bores, wherein the other of the top and bottom surfaces of each block includes a plurality of posts extending from the other surface of each block into the bore of an adjacent block with an interference fit, the assembly further comprising a cap engaging a block and a vertically extending tension member, wherein one end of the tension member is connected to the cap and the other end of the tension member is anchored, whereby the assembly is secured.

15. An assembly of interlocked structural foam polymer building blocks as defined in claim 14 wherein each block has a hollow core and wherein the vertically extending tension member extends through the hollow cores.

16. An assembly of interlocked structural foam polymer building blocks as defined in claim 14 wherein each block has a central interior wall defining two chambers, and wherein the cap is positioned within a chamber of a block, and wherein the cap is sized to closely fit within the chamber.

17. An assembly of interlocked structural foam polymer building blocks as defined in claim 14 wherein the cap substantially covers the top surface of the at least one block.

18. An assembly of interlocked structural foam polymer building blocks as defined in claim 14 wherein the cap includes integral reinforcing ribs.

19. The assembly of claim 14 wherein the plurality of posts have a frusto-conical shape and extend generally perpendicularly to the other surface.

* * * * *